US009573391B2

(12) United States Patent
Ma et al.

(10) Patent No.: US 9,573,391 B2
(45) Date of Patent: Feb. 21, 2017

(54) PARTIAL CURE OF UV INKS DURING PRINTING

(71) Applicant: APS Engineering, Escondido, CA (US)

(72) Inventors: Zeying Ma, San Diego, CA (US); Jaren Dayle Marler, Escondido, CA (US)

(73) Assignee: APS Engineering, Escondido, CA (US)

( * ) Notice: Subject to any disclaimer, the term of this patent is extended or adjusted under 35 U.S.C. 154(b) by 0 days.

(21) Appl. No.: 14/519,978

(22) Filed: Oct. 21, 2014

(65) Prior Publication Data

US 2015/0165786 A1 Jun. 18, 2015

Related U.S. Application Data

(60) Provisional application No. 61/893,773, filed on Oct. 21, 2013.

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 2/01; B41J 2/435
See application file for complete search history.

(56) References Cited

U.S. PATENT DOCUMENTS

2007/0189018 A1* 8/2007 Tausch et al. ..... 362/346
2008/0311299 A1* 12/2008 Furukawa ..... 427/261
2012/0314012 A1* 12/2012 Roof et al. ..... 347/102

* cited by examiner

*Primary Examiner* — Kristal Feggins
*Assistant Examiner* — Kendrick Liu
(74) *Attorney, Agent, or Firm* — Harness, Dickey & Pierce, P.L.C.

(57) ABSTRACT

A printing system includes a media transport system configured to transport a web of print media through a printing zone at a transport speed in a transport direction proceeding from up-web to down-web. A plurality of printheads each at least spanning the print zone and each configured to eject a radiation-curable ink. At least one PIN is unit positioned between two of the printheads relative the transport direction and configured to emit radiation onto the print media to partially cure the ink emitted by a printhead that is up-web from the PIN unit. A controller controls a power level of the PIN unit so that the radiative power level of the PIN unit decreases as the transport speed increases.

6 Claims, 5 Drawing Sheets

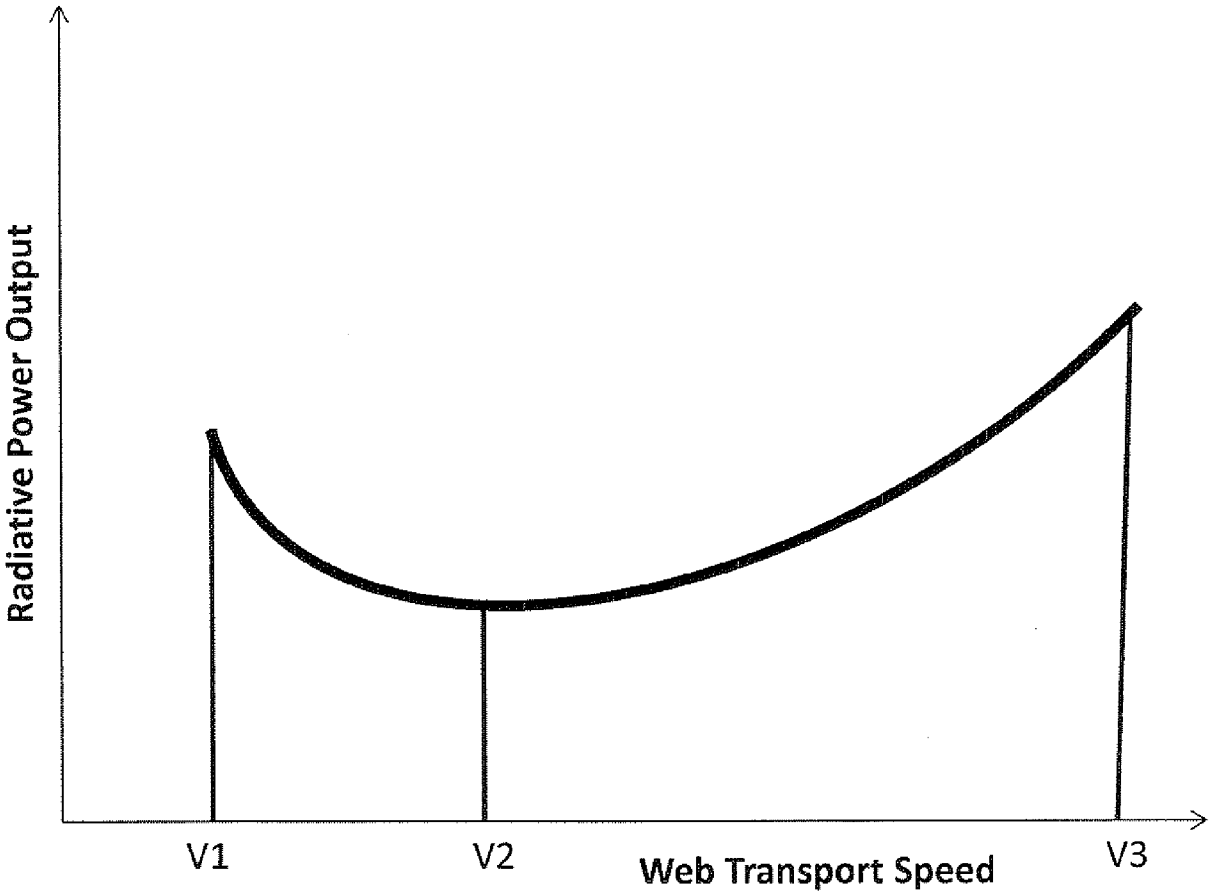
FIG. 4: PIN Unit Radiative Power versus Web Transport Speed

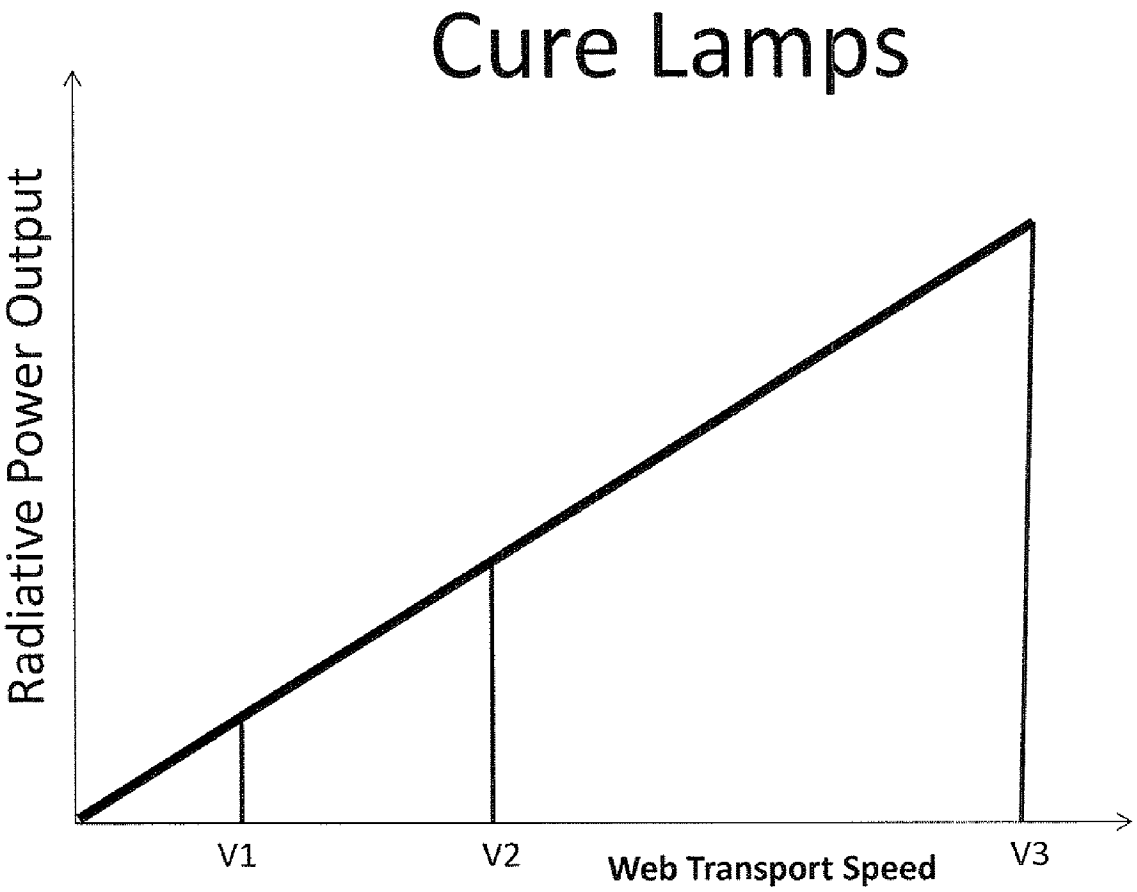
FIG. 5: Cure Unit Radiative Power Output versus Web Transport Speed

PARTIAL CURE OF UV INKS DURING PRINTING

CROSS-REFERENCE TO RELATED APPLICATIONS

This application claims priority to U.S. Provisional Patent Application Ser. No. 61/893,773 filed Oct. 21, 2013. The entire disclosure of the above application is incorporated herein by reference.

FIELD OF THE INVENTION

The present invention relates to digital commercial or industrial printing system utilizing printheads to eject dot matrix patterns of drops of UV curable ink upon a web of print media to form images and text. More particularly the present invention relates to a "PIN" unit emitting radiation at a power level to partially cure ink between two printheads using an advantageous power level versus transport speed.

BACKGROUND

A rapid change is occurring in the commercial and industrial printing marketplace with an expanded use of digital printing presses to replace their analog counterparts. Digital printing presses have an advantage of lower "set-up" costs in that a change to a print pattern is accomplished with a file change. This improves the economics of "short run" printing and reducing a need to print large inventories of a given design.

One common form of digital printing press is a web press based upon inkjet printing of radiation curable inks. In this embodiment a roll of media is unwound and then passed through a paper path defined by a series of rollers. A part of the paper path is a print zone within which inkjet printheads eject a dot matrix pattern of fluid drops on a surface of the media thereby forming images and/or text on the media surface.

An important factor with radiation curable inks is a tendency to flow between depositing the inks and providing a radiation cure of the inks. Another factor is a tendency of inks having different primary colors to intermix. A certain amount of flow and intermixing can be desirable but there is an optimal level in order to maximize resultant image quality.

To control flow and intermixing PIN units can be used to "pin down" the ink to a certain extent to reduce flow and mixing. The effect of these units has been found to change with the transport speed of the print unit in unexpected ways.

BRIEF DESCRIPTION OF THE DRAWINGS

FIG. 4 is a graphical representation of a radiative power output of a PIN unit versus a web transport speed.

FIG. 5 is a graphical representation of a radiative power output of a cure lamp versus a web transport speed.

Corresponding reference numerals indicate corresponding parts throughout the several views of the drawings.

DETAILED DESCRIPTION

Figure 1:
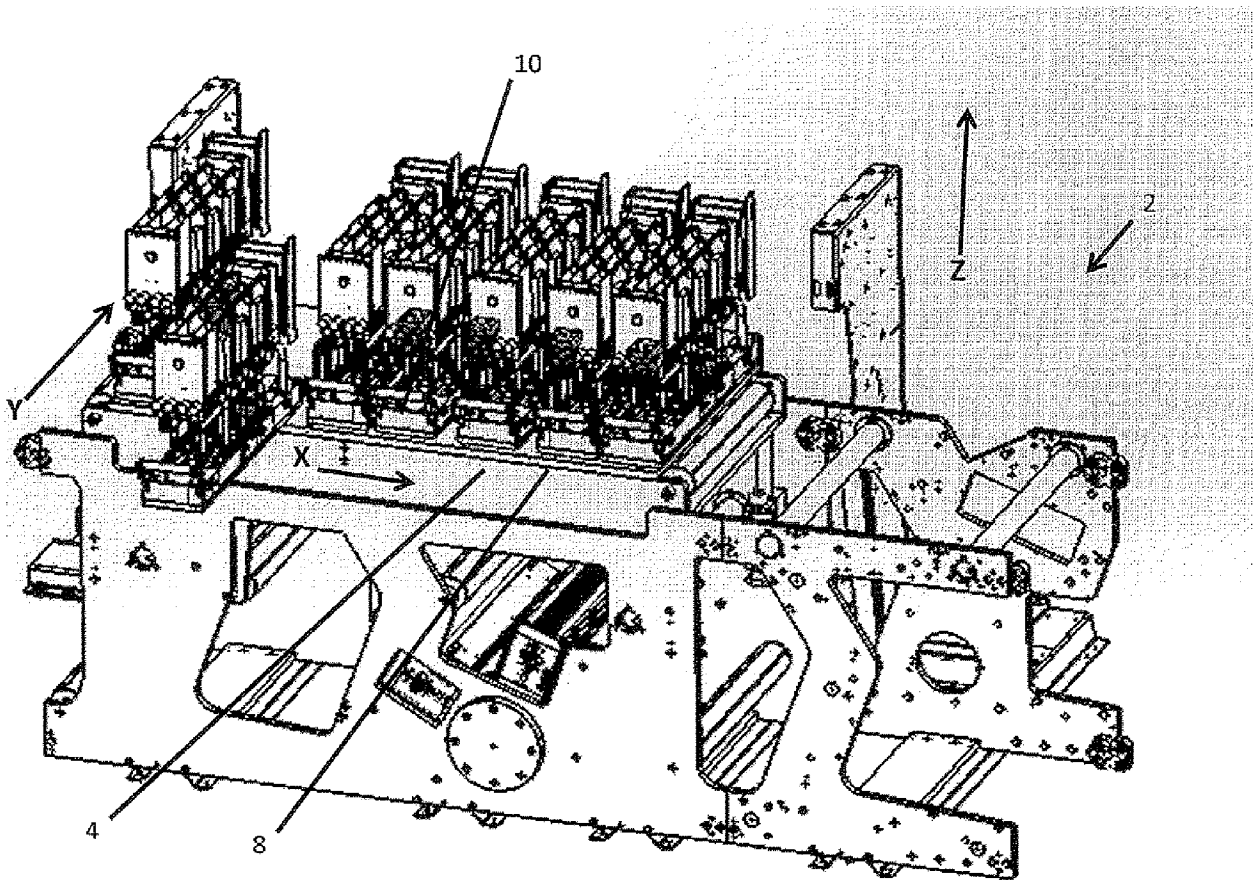
FIG. 1 is an isometric view of an exemplary printing system.

FIG. 1 is an isometric view of an exemplary embodiment of a commercial or industrial printing system 2. The printing system 2 includes a media transport system 4 configured to transport a web of print media 6 (see FIG. 2) from a source or roll of print media (not shown) through a print zone 8. Within the print zone 8 printheads 10 operate to eject radiation-curable drops of ink on media 6 in a dot matrix form to form text and images on a surface of the media 6.

Within the print zone 8 the media is transported in a direction X through the print zone. The printheads 10 each at least a portion of the print media along a transverse or cross-web direction Y. Each printhead 10 ejects droplets upon the media along a vertical axis Z.

Figure 2:
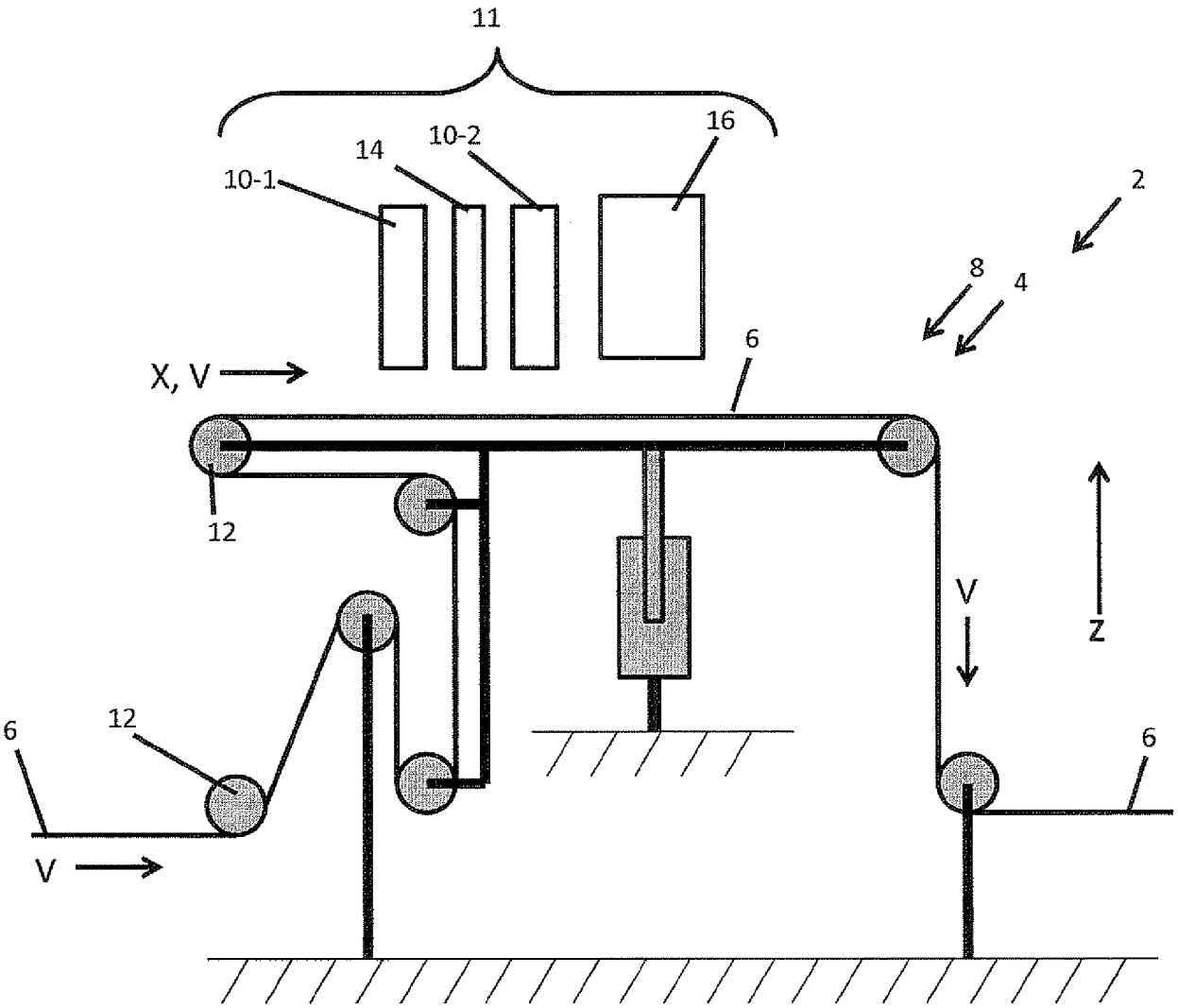
FIG. 2 is a side view of an exemplary printing system.

FIG. 2 is a side view of an exemplary printing system 2 depicting a geometric arrangement of printing system components. The media transport system 4 transports a web of print media 6 through the print zone 8 utilizing a series of rollers 12. In this preferred embodiment, the media moves along a circuitous media path along a media transport direction V which varies in direction with respect to X and Z. The direction V coincides with the direction X across print zone 8 over which V has no Z-component. A "down-web" direction refers to a direction of media transport. An "up-web" direction is opposite to the down-web direction.

Arranged in the print zone along the transport direction V are a series of modules or units 11 including printheads 10, PIN units 14, and a curing unit 16. Only two printheads 10 and one PIN unit 14 is shown for simplicity but it is to be understood that any number of such units may be used. Each of the modules spans at least a portion of the print zone in transverse direction Y (cross-web direction).

The arrangement of the modules 11 relative to the transport direction V is important. A first printhead 10-1 is up-web of the remaining modules 11. First printhead 10-1 emits a dot matrix pattern of UV-curable ink onto media 6 in a first color (preferably a primary color).

Immediately down-web of printhead 10-1 is PIN unit 14. PIN unit 14 emits a wavelength of light with a power sufficient to partially cure the UV-curable ink from printhead 10-1. The power of the PIN unit 14 needs to be sufficient to reduce or eliminate a flow of UV ink just emitted by printhead 10-1. In one embodiment PIN unit is an array of LED's emitting blue or UV light.

Immediately down-web from PIN unit 14 is second printhead 10-2 that emits a second (preferably primary) color. Down-web from printhead 10-2 is a cure unit that emits UV light for providing a complete cure of the UV-curable inks. In one embodiment the cure unit 16 is UV arc lamp. In another embodiment the cure unit 16 is an array of LED's. An important aspect of the arrangement of printing system 2 is that a PIN unit is arranged between two printheads with respect to the media transport direction V.

Figure 3:
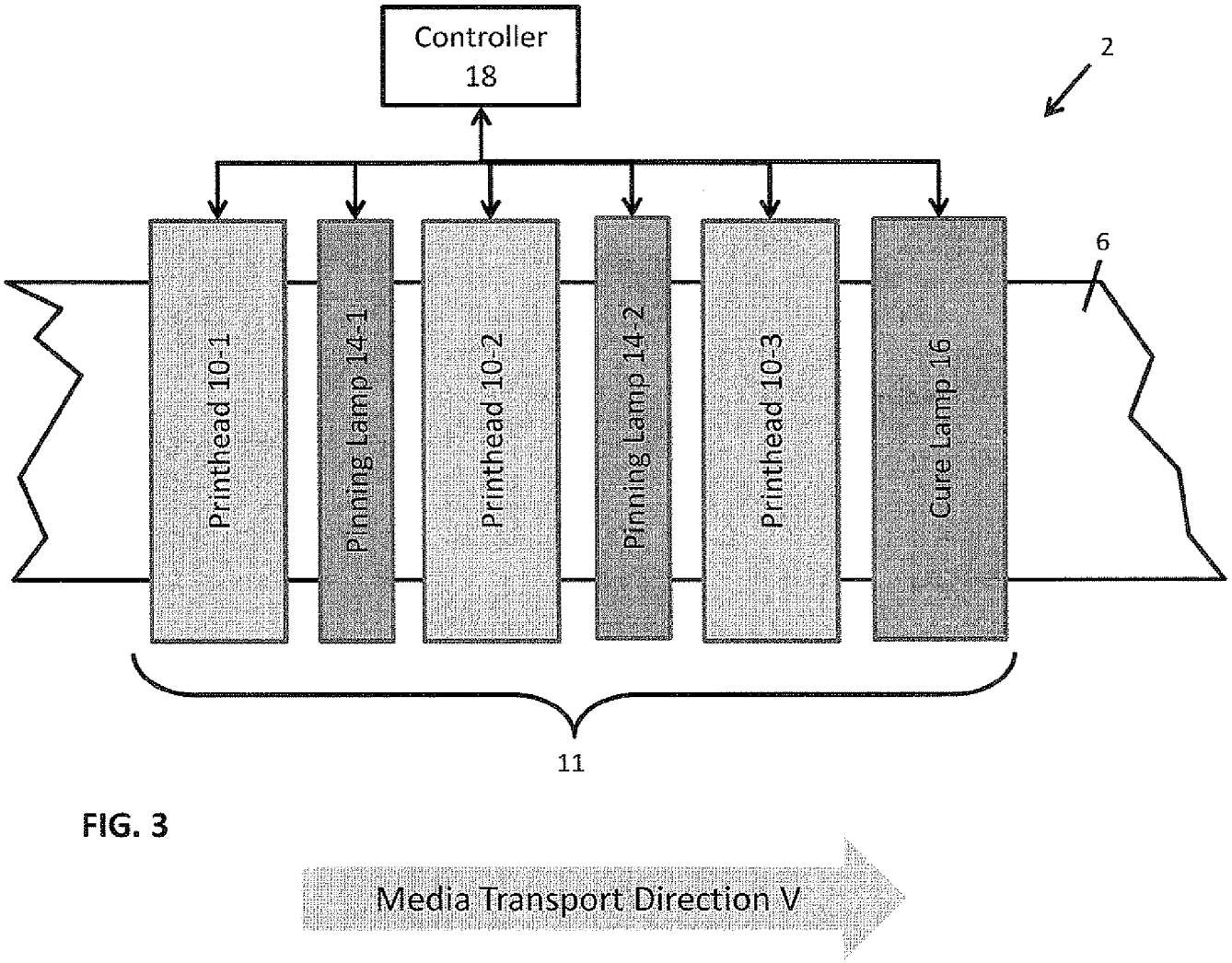
FIG. 3 is a simplified plan view of a print zone of an exemplary printing system.

FIG. 3 depicts a top view of printing system 2 with some additional modules 11. Modules 11 are preferably arranged along the transport direction in the following sequential order: (1) first printhead 10-1, (2) first PIN unit 14-1, (3) second printhead 10-2, (4) second PIN unit 14-2, (5) third printhead 10-3, and (6) cure lamp 16. The printheads 10-1, 10-2, and 10-3 each emit a different (preferably primary) color of a radiation curable ink. In one embodiment they each emit one of cyan, yellow, and magenta UV inks.

Coupled to each of the modules 11 is a controller 18. Controller 18 may be a single controller or it may include multiple controllers 18. However it is to be understood that multiple controllers 18 can be coordinated to operate cooperatively based on the state of and operation of printing system 2.

Controller 18 is configured to independently control the radiative power output of PIN units 14 and cure lamp 16.

When PIN units 14 and/or cure unit 16 are arrays of LED's then the radiative power can be controlled for example via PWM (pulse width modulation), or other suitable means. When cure unit 16 is a mercury lamp then the power output may be controlled for example by a shutter, or other suitable means.

FIG. 4 shows a radiative power output versus media web speed curve for a typical PIN unit 14. As can be seen, the optimum cure intensity is a minimum for an intermediate level of speed V1. Below that speed there is more transit time for printed dots to flow and therefore the dots need to be more fully cured. Above that speed there is a need to apply more power in order to provide a minimum energy per unit area.

FIG. 5 shows radiative power output versus media speed for a typical cure unit 16. As shown in FIG. 5 the power level of cure unit 16 is nearly or entirely linear with web transport speed. Thus the final cure energy per unit area of the media is roughly a constant for a given media transit speed.

Referring to FIGS. 4 and 5 there is a first range of transport speeds (depicted as being between a lower speed V1 and an intermediate speed V2) within which the radiative power output of the PIN unit 14 decreases while the radiative output power of cure unit 16 increases. Then there is a second range of transport speeds (depicted as being between intermediate speed V2 and higher speed V3) within which the radiative power output of both the PIN unit 14 and the cure unit 16 both increase. Between V1 and V2 is an overall range of "permissible" transport speeds that are transport speeds over which printing may be optimized for a given speed.

Referring now to FIG. 4 the radiative power output versus transport speed of the PIN unit 14 is nonlinear with a minimum value at an intermediate web transport speed V2 and maxima at speeds V1 and V3. The curve may also be described as "bathtub-shaped." The curve in FIG. 4 contains a portion or all of a range of permissible transport speeds as a dependent variable.

The power level and transport speed can be adjusted to achieve a desired amount flow and intermixing can of the inks to achieve the desired image quality.

Further areas of applicability will become apparent from the description provided herein. The description and specific examples in this summary are intended for purposes of illustration only and are not intended to limit the scope of the present disclosure.

What we claim is:

1. A printing system comprising:

a media transport system configured to transport a web of print media through a printing zone at a transport speed in a transport direction proceeding from up-web to down-web;

a plurality of printheads each at least partially spanning the print zone and each configured to eject a radiation-curable ink;

at least one PIN unit positioned between two of the printheads relative the transport direction and configured to emit radiation onto the print media to partially cure the ink emitted by a printhead that is up-web from the PIN unit; and a controller configured to control a power level of the PIN unit whereby, for a range of transport speeds, the radiative power level of the PIN unit decreases as the transport speed increases.

2. The printing system of claim 1 wherein the controller controls the power level of the PIN unit whereby the radiative power level of the PIN unit versus transport speed defines a nonlinear curve having a minimum at an intermediate value within a range of permissible media transport speeds.

3. The printing system of claim 1 further comprising a cure unit that is down-web from the plurality of printheads and wherein the controller controls a power level of the cure unit whereby the radiative power level of the cure unit increases monotonically over the range of transport speeds.

4. The printing system of claim 1 wherein the PIN unit includes an array of light emitting diodes that at least partially spans the print zone.

5. The printing system of claim 1 wherein the PIN unit includes one or more of an array of light emitting diodes and a mercury lamp.

6. A printing system comprising:

a media transport system configured to transport a web of print media through a printing zone at a transport speed in a transport direction;

a plurality of printheads each at least partially spanning the print zone and each configured to eject a radiation-curable ink;

a plurality of PIN units each positioned after one of the printheads relative to the transport direction and each configured to partially cure the radiation curable ink;

a controller configured to control a radiative power level of each PIN unit according to the transport speed thereby defining a nonlinear radiative power versus transport curve that has a minimum in the curve at a transport speed that is intermediate to a range of permissible transport speeds.

* * * * *